United States Patent [19]

Wilkis

[11] Patent Number: 4,533,206

[45] Date of Patent: Aug. 6, 1985

[54] FLEXIBLE PRINTED CIRCUIT CONNECTOR

[75] Inventor: Anthony J. Wilkis, Downers Grove, Ill.

[73] Assignee: Rockwell International Corp., El Segundo, Calif.

[21] Appl. No.: 619,867

[22] Filed: Jun. 12, 1984

Related U.S. Application Data

[63] Continuation of Ser. No. 373,574, Apr. 30, 1982, abandoned.

[51] Int. Cl.[3] ..... H01R 13/12

[52] U.S. Cl. ..... 339/258 R; 339/176 MF

[58] Field of Search ..... 339/17 C, 17 F, 18 R, 339/176 MF, 176 MP, 221 R, 256 SP, 258 R, 258 P

[56] References Cited

U.S. PATENT DOCUMENTS

| | | | |
|---|---|---|---|
| 3,243,757 | 3/1966 | Cobaugh | 339/221 R |
| 3,526,870 | 9/1970 | Mayala | 339/97 R |
| 3,671,919 | 6/1972 | Kauffman | 339/17 R |
| 3,918,784 | 11/1975 | Lemke et al. | 339/176 MP |
| 3,985,414 | 10/1976 | Walter et al. | 339/97 R |

FOREIGN PATENT DOCUMENTS

| | | | |
|---|---|---|---|
| 2077521 | 12/1981 | France | 339/258 R |
| 1260819 | 4/1961 | United Kingdom | 339/18 R |

*Primary Examiner*—Joseph H. McGlynn
*Attorney, Agent, or Firm*—Carmen B. Patti; V. Lawrence Sewell; H. Frederick Hamann

[57] ABSTRACT

A connector for fitting on a printed circuit board wire wrapped terminal post. The connector has a contact finger which is spring biased against the terminal post, so that for several of the connector-post combinations, a ribbon cable can be held inserted between the contact fingers and their associated posts. The contact fingers make connection with the conductor of the ribbon cable. In another embodiment, the connector makes connection between a wire wrapped terminal post and a contact on the printed circuit board.

4 Claims, 7 Drawing Figures

FLEXIBLE PRINTED CIRCUIT CONNECTOR

This application is a continuation of application Ser. No. 373,574, filed Apr. 30, 1982, now abandoned.

BACKGROUND OF THE INVENTION

The invention disclosed herein pertains generally to the field of the electrical connectors, and more particularly to those types of connectors for establishing electrical connections between the conductors of flexible cables and terminal posts.

The widespread use of multiconductor flexible cables has encouraged the development of a multitude of connector assemblies to interface the cable conductors to terminal parts. The popularity of such cables is due in part to the ease and reliability with which a large number of connections can be made. The cables, being flat, are easily stacked or folded to conserve valuable space. In addition, the fixed position of the conductors embedded within the insulating material provides a cable with constant electrical characteristics.

Ribbon cables having stranded wire or solid round conductors are widely used, however the trend is toward the use of the flat conductor type of cable which is more flexible and has better heat dissipating characteristics. It is the latter type of cable, although not exclusively, to which the present invention is well suited.

The ribbon cable advancement has brought with it a plethora of connector assemblies for mating the cable conductors to the terminal posts of printed circuit boards, backplanes and other similar apparatus. A common aspect to most of these connectors is that the termination requires soldering, brazing or crimping the connector terminals to the cable conductors. One economical method, yet requiring special tools, is the insulation displacement style of connection where a knife-edge part of the connector terminal is crimped into the metallic cable conductor.

Irrespective of the manner in which the connectors are joined to the cable conductors, a major cost of the installation is attributed to the connector itself which includes as one element a nonconductive contact housing. The contact housing, generally of some plastic composition, rigidly houses the contacts in a variety of spaced arrangements to accommodate a corresponding variety of terminal post configurations.

It is therefore an object of the present invention to provide a simple connecting element for connecting each flexible conductor path to an associated terminal post.

It is a further object of the present invention to provide a one-piece connecting element for terminating flat flexible conductor paths to terminal posts which element requires no crimping, soldering or special tools to complete the installation.

Yet another object of the present invention is to provide a connecting element which is installed on the terminal post rather than affixed to the ribbon cable.

The foregoing as well as other objects and advantages will become apparent by referring to the detailed description of the preferred embodiment, which follows hereinafter together with the appended drawings.

SUMMARY OF THE INVENTION

In accordance with the foregoing objects, the invention herein disclosed pertains to a connector device for mating flexible cable conductors to terminals primarily of the wire-wrap type.

An electrical connector device embodying the principles of the present invention, by virtue of its one-piece construction and simple design, is well adapted to miniaturization and automated mass production.

The connector device comprises a sleeve-type receptacle formed in substantially the same cross-sectional size and shape as the terminal post over which it is to be inserted. The intimate contact existing between the receptacle and the terminal post establishes an electrical connection of sufficient conductivity to carry the amount of current normally encountered in flat ribbon cable conductor paths.

Extending from the sleeve receptacle, and formed as an integral extension of the sleeve, is a resilient finger connecting the receptacle to a contact area existing at the end of the finger member. The interconnecting finger is of sufficient length and formed so as to provide the resiliency necessary to forcibly urge the contact member against the terminal post surface when such a connector is installed over the terminal post.

A connection is effected between the terminal post and the ribbon cable conductor path when such path is inserted between the terminal post and the connector contact surface. The pressure exerted between the contacting surfaces is now even greater since the interposition of the flexible conductor path, between the terminal post and the connector contact surface, deforms the resilient connector finger from its rest position.

In the preferred embodiment the finger part of the connector device is "over-formed" to insure that a sufficient tension exists between the terminal post and the connector contact surface. Also disclosed are other types of finger configurations suitable for connecting conductors to terminal posts.

The installation of multiple connector devices having the configurations disclosed simply entails slipping a number of such devices over aligned terminal posts and sliding the flexible cable conductors between the terminal posts and the contact surfaces of the connector. In those applications where the flexible cable is succeptable to lateral movement, one or more of the cable conductor paths may be notched so that portions of the ribbon cable straddle the connector itself to thereby eliminate lateral movement of the flexible cable and preserve cable conductor-terminal post alignment.

While the invention has been shown and will be described with reference to the specific exemplary embodiments, there is no intention that it thus be limited to the particular aspects or details of such embodiments. On the contrary, it is intended here to cover all modifications, alternatives, or equivalents and subcombinations which fall within the spirit and scope of the invention as defined by the appended claims.

DETAILED DESCRIPTION OF THE INVENTION

Figure 1:
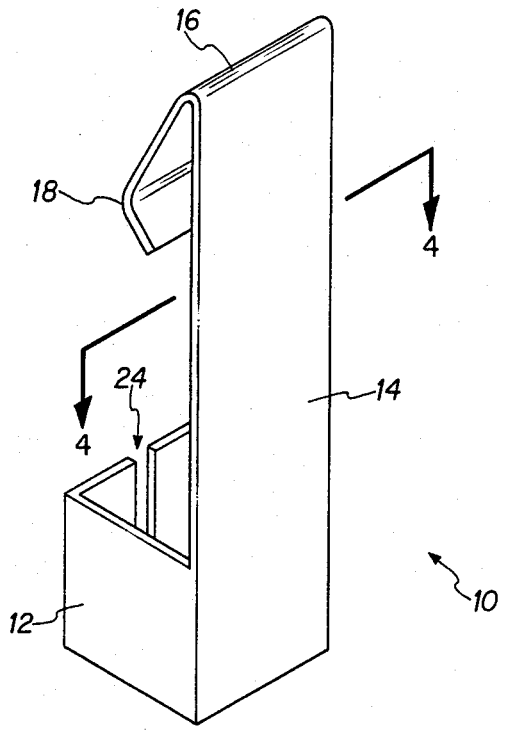
FIG. 1 is a perspective view showing the unitary construction aspect of the connector device in its rest position.

Referring to FIG. 1 of the drawings, a connector device in accordance with the present invention includes a sleeve receptacle portion 12, a contact surface 18 and an elongated finger member 14 connecting both such elements.

Particularly, the slip-on connector device is shown in its rest position. The simplicity of construction is apparent by noting the one-piece nature of the connector, and the ease with which the outline thereof can be automatically stamped out of flat metal stock. The formation of the connector device is of equal simplicity since it requires at most six bending operations to complete the finished connector. Worthy of note is the fact that all corners are simple bends, none of which require elaborate machinery.

The illustrated slip-on connector is preferably constructed from a metal, or an alloy, such as beryllium copper or phosphor bronze. In those applications where the environment necessitates a particular contact surface composition, the contact surface 18 can be selectively electroplated with gold, tin or tin-lead.

In addition, the material stock from which the slip-on connectors are punched can be selectively plated with a desired conductive material such that the inner surfaces of the sleeve receptacle portion 12 provide the desired ohmic contact between the receptacle and the terminal post.

For connectors adapted for use with square wire-wrap terminal posts, the receptacle portion of the connector is simply folded back onto itself in a square configuration having a similar dimensional peripheral boundary as the terminal post to be used, but slightly undersized so that the connector device can be frictionally installed over the terminal post. An advantage flowing from the weldless nature of the connector is that the gap 24, existing between the folded receptacle portion, allows a terminal post of slightly oversized dimensions to yet be used. Such a mismatch is accommodated by the existance of the gap 24 which further separates to embrace such an oversized post.

Moreover, a terminal-connector connection may yet be established in instances where the terminal post is undersized. In this instance, as will be described more completely below, the resilient spring action of the elongated finger member 14, urging the contact surface 18 against the terminal post, effects a connection between the uppermost edge of the receptacle back wall and the lowermost edge of the receptacle front wall.

Accordingly, the slip-on connector, by virtue of its construction, is very forgiving of the dimensional tolerance of the terminal post with which it may be used.

Figure 2:
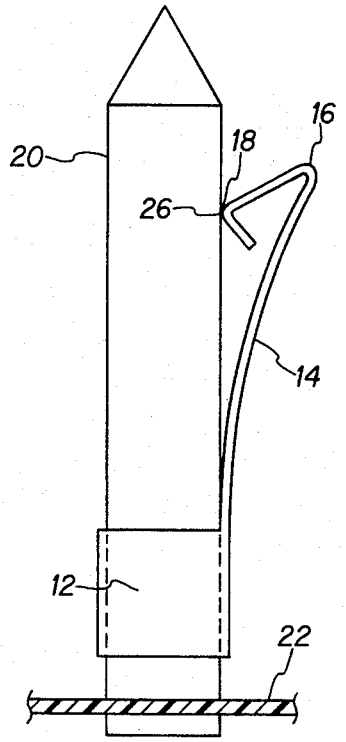
FIG. 2 is an elevation view of the connector device, after having been installed over a terminal post, illustrating the tension applied by the connector contact surface upon the terminal post surface.

Turning now to FIG. 2, the illustrated connector is shown installed on a terminal post. It should be noted that the installation of the slip-on connector requires no special crimping tools to install the connector on the terminal post or to effect a connection between the flexible flat conductor and the terminal post. Specifically illustrated is the distorted configuration of the elongated finger member 14 which, because of the resilient properties of the base metal, causes the contact end of the connector to be forcefully urged against the terminal post surface. Moreover, a second region of resiliency exists between the device contact surface 18 and the first corner bend 16. This double resiliency action assures a good connection between either the connector device contact surface 18 and the flexible conductor, or the terminal post surface and the inserted flexible conductor. In actual practice, the conductor of a flexible cable would be insertably "sandwiched" between the terminal post surface 26 and the connector contact surface 18. It can be appreciated that irrespective of the orientation of the flexible cable, electrical conductivity will exist between the flexible conductor and the terminal post. In situations where the flexible cable conductors are oriented to face the terminal post, the slip-on connector merely serves as an agent to forcefully urge the cable conductor path against the terminal post. In those instances where the flexible cable conductor contact faces the slip-on connector surface 18, the slip-on connector serves as both a mechanism for establishing an electrical connection between the terminal post 20 and the flexible conductor, and as a mechanism for forcibly sandwiching the cable between the terminal post and the connector.

The slip-on connector device 10 is especially well suited in those situations where a double sided conductor cable is used for power and ground purposes. In many such instances circuit power or ground returns are paralleled to reduce the resistance of the dc circuits. The use of the connector device 10 at each cable end automatically provides a short circuit between the pair of conductors separated by the cable nonconductive material.

It can be visualized from FIG. 2 that the manual insertion of the ribbon cable between the connector device contact surface 18 and the terminal post creates a wiping action which tends to clean the contace surfaces of oxides. The removal of oxides, which form as a result of environmental exposure, reestablishes low ohmic contact surfaces.

The phosphor bronze type of metal stock is especially well suited because of its high degree of conductivity and because of its resiliency which aids, as heretofore mentioned, in forcing the flexible cable against the terminal post. Of course, depending on the particular applications, other materials may be used to enhance conductivity or resiliency, or economies of cost.

Figure 3:
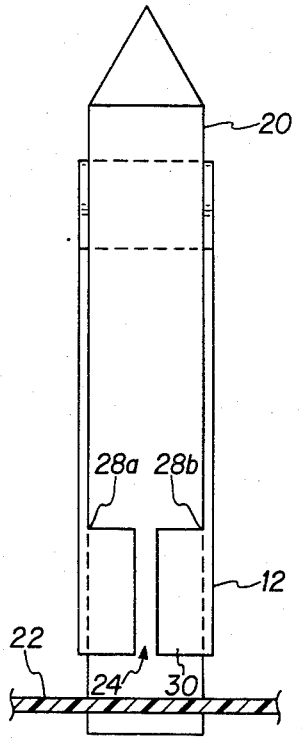
FIG. 3 is a back elevation view of the connector device illustrating the sleeve portion of the conductor.
Figure 4:
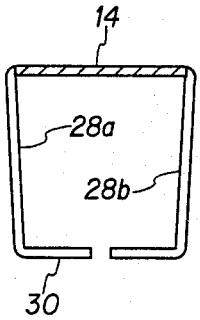
FIG. 4 is a sectional plan view of the sleeve receptacle portion of a connector device according to the invention.

FIG. 3 is a back view of the slip-on connector device illustrating the gap portion 24 formed so that the sleeve receptacle portion may accommodate irregular-sized terminal posts. To this end, the side wall portions of the receptacle can be purposefully overbent to provide a better contact between the device side walls **28*a* and 28*b* and the various sized terminal posts. FIG. 4 shows the receptacle portion of the device according to the invention in which the side walls 28*a* and 28*b* are overbent. The receptacle portion is shown in plan view, with finger member 14** sectioned.

Figure 5:
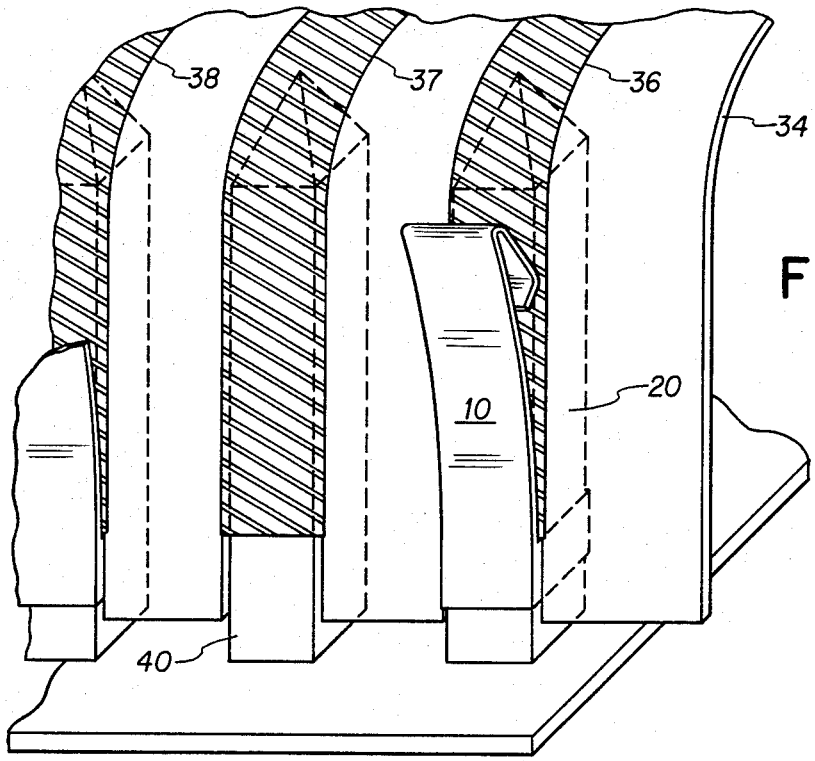
FIG. 5 is a perspective view of the connector device, a terminal post, and the interposition of the flexible flat ribbon cable conductor therebetween.

With reference now to FIG. 5, there is shown the cooperation between the terminal post 20 and the installed slip-on connector device to "sandwich" the flexible flat conductor therebetween. As illustrated, the interconnection of a plurality of aligned terminal posts with associated flexible conductor paths is easily accomplished by simply installing the requisite number of slip-on connectors 10 on the terminal posts to which connections are desired. One advantage in installing the flexible cable 34 as oriented in FIG. 5, is that where it is desired that one of the conductor 37 should not be connected to a terminal post, a slip-on connector is simply not installed at that position. Were it not for this particular orientation (viz, the conductor path facing away from the terminal post), the conductor path 37 could inadvertantly touch the terminal post even in the absence of a connector device 10.

FIG. 5 also shows a slot 40 cut at each conductor path location to thereby eliminate lateral motion of the flexible cable 34. Were it not for these slots 40, vibration or cable movement could misalign the conductor paths and the corresponding terminal posts.

For maximum contact conductivity, it is preferred that the slip-on connector 10 width be at least equal to the width of either the conductor path 36 or the terminal post 20.

Figure 6:
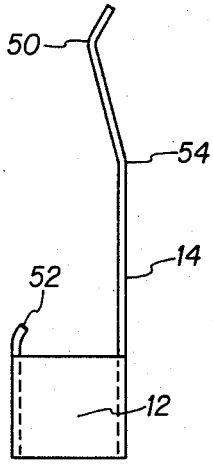
FIG. 6 is a side elevation view of an alternative embodiment of the one-piece connector device having a different finger member and contact surface configuration.

Referring now to FIG. 6, an alternative connecting surface is provided at the end of the elongated finger member. Such a configuration, although requiring different bending operations, enjoys the same advantages (except double resiliency) as heretofore discussed with respect to the connector shown in FIG. 1. As shown in FIG. 6, the finger member 14 is not overformed but rather is formed at its end with a first bend 54 which causes the contact surface 50 to be projected into the area occupied by the terminal post when such connector is installed thereon. Also shown is a tab 52 extending from each flap of the receptacle back wall. In those applications where extra gripping action is desired between the connector receptacle and the terminal post, such a tab can be bent slightly toward the inner portion of the sleeve receptacle to thereby cause that portion of the receptacle wall to press tightly against the terminal post surface. Such a tab also prevents migration of the connector device toward the terminal post end due to vibration or repeated flexible cable extractions.

Figure 7:
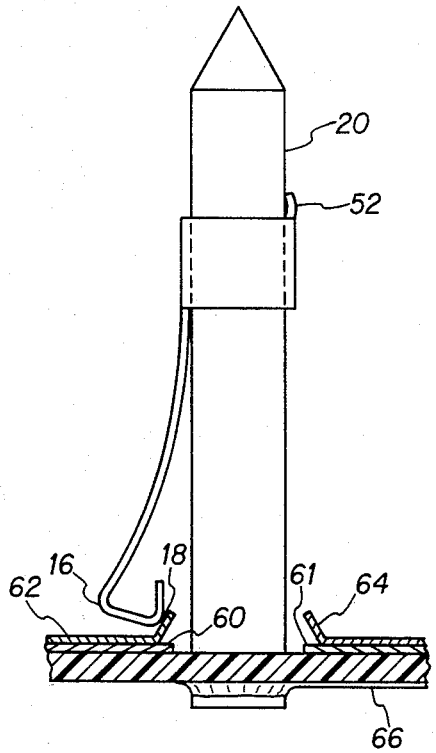
FIG. 7 is a side elevation view of yet another embodiment illustrating an applicaiton for providing a connection between a terminal post and one of a plurality of optional contacts on a printed circuit board.

Still another significant advantage of the slip-on connector may be observed in FIG. 7. The embodiment shown therein is similar to that shown in FIG. 1, with the exception that the first corner bend 16 does not form an acute angle. At most, the angle subtended by the bend 16 is a right angle. The contact surface 18, however, is bent to form an acute angle.

Such an arrangement is advantageous where it is desired to selectively establish connections between a terminal post and one of many printed circuit board paths. FIG. 7 illustrates this facet by showing printed circuit board (PCB) contact elements 62 and 64 soldered or mechanically fastened to the respective printed circuit board paths 60 and 61. A connection may be made to element 62 by simply orienting the slip-on connector in a direction so that when such connector is installed on the terminal post the contact surface 18 makes contact with the desired element 62. A connection is thereby effected between the desired PCB path 60 and the terminal post path 66 soldered to the terminal post on the bottom of the circuit board. If, on the other hand, a connection is desired between the terminal post path 66 and the printed circuit board element 64, the slip-on connector is simply turned 180 degrees and reinstalled on the terminal post.

It may be envisioned by those skilled in the art that this arrangement can be utilized with a plurality of optional contact elements encircling a round terminal post. In this manner, the intimate connection between the contact surface 18 and the desired PCB element prevents rotation of the slip-on connector about the circular terminal. This embodiment provides for a simple, easily changeable method of optionally connecting one point to one of a plurality of other connection points.

While the arrangement shown in FIG. 7 illustrates the connector device contact 18 being biased against the PCB contact element 62 in a direction toward the terminal post 20, the connector device can as well be formed so that the device contact surface is biased against the PCB element in a direction away from the terminal post. In this situation, contact would be effected on side opposite the mated side of the upright portion of the PCB element 62 shown in FIG. 7.

Throughout this disclosure, the connector device has been discussed in conjunction with the use of ribbon cables having flat conductor paths. It should be understood, however, that with slight modifications to the contact surface 18 the device can accommodate cables with round conductors. Although requiring an additional step in the manufacture thereof, the contact surface can be formed with a detent to accept a round conductor. This aspect would prevent the connector device contact surface from inadvertently slipping off the round conductor, and would also generally prevent lateral motion of the ribbon cable.

While the slip-on connector is shown by way of various embodiments, those skilled in the art may, by choice, devise other configurations which yet fall within the spirit and scope of the appended claims.

What I claim as my invention is:

1. An electrical connector for mating a conductor path of flat flexible cable to a rigid terminal post, comprising:

a conductive base means having a longitudinal access with a rectangular cross-sectional shape substantially the same as the cross-sectional shape of said terminal post and four sides having a uniform longitudinal dimension and a gap extending along the entire longitudinal length of one side and circumferentially sized to provide a tight sliding fit over said terminal post, whereby electrical contact between said base means and said base post is established;

a conductive elongated finger resiliently fixed to said base means and extending from said base means in a direction generally parallel to said longitudinal access;

contact means connected to said finger and extending in a direction toward said base means longitudinal access in an amount sufficient to cause said finger to be deflected by terminal post surface making contact with the contact means when the terminal post is inserted into said connector and having a width substantially equal to said base means and said finger;

whereby, upon sandwiching said flat flexible cable conductor path between said terminal post and said contact means, an electrical connection is effected between said terminal post and said conductor path.

2. A one-piece slip-on connector formed of sheet material and adapted for providing an electrical connection between a rectangular terminal post and a flat flexible conductor, comprising:

a sleeve receptacle means, having a longitudinal axis and a four-sided thin wall portion with a substantially rectangular cross-sectional configuration slightly larger than that of the terminal post periphery and a gap along the entire longitudinal length of one side, for embracing said terminal post and forming an electrical connection therebetween;

a contact member being an extension of a portion of said sleeve receptacle thin wall portion in a directional aligned with said longitudinal axis, and of sufficient length to be resiliently deflectable, and at the end of said member a first angular bend being generally perpendicular to the longitudinal axis of said sleeve means, with the exterior corner of the bend defining a contact surface, intermediate between said first bend and said sleeve means a second angular bend being generally perpendicular to the longitudinal axis of said sleeve means and disposed in a direction to cause said contact surface to be projected into the space displaced by said embraced terminal post;

whereby the deflection of said contact member due to the insertion of said connector over said terminal post causes the contact surface to be forcibly biased against the terminal post surface so that a flat conductor interposed between said terminal post surface and said connector contact surface effects an electrical connection between said flat conductor and said terminal post.

3. An electrical connector system for mating selected conductor paths of a flat flexible cable to selected rigid terminal posts, comprising:

a plurality of connectors each having, a conductive base means having a longitudinal access with a cross-sectional shape substantially the same as the cross-sectional shape of said terminal post, and circumferentially sized to provide a tight sliding fit over said terminal post, whereby electrical contact between said base means and said base post is established;

a conductive elongated finger resiliently fixed to said base means and extending from said base means in a direction generally parallel to said longitudinal access;

contact means connected to said finger and extending in a direction toward said base means longitudinal access in an amount sufficient to cause said finger to be deflected by terminal post surface making contact with the contact means when the terminal post is inserted into said connector;

whereby, upon sandwiching said flat flexible cable conductor path between said terminal post and said contact means, an electrical connection is effected between said terminal post and said conductor path; and flexible conductive portions of said cables aligned with said terminal posts and having an insulated portion of said cable disposed between said conductive portions and said posts, said connectors selectively installed on said posts electrically connecting said conductive portions to said posts at said contact means and captively holding said cable to said posts.

4. The slip-on connector of claim 2 wherein said connector is formed of sheet material having six angular bends.

* * * * *